US007804459B2

(12) United States Patent
Chung et al.

(10) Patent No.: US 7,804,459 B2
(45) Date of Patent: Sep. 28, 2010

(54) TRANSMISSION LINE LOADED DUAL-BAND MONOPOLE ANTENNA

(75) Inventors: Shyh-Jong Chung, Hsinchu (TW); Yu-Hsin Wang, Taichung (TW); Yu-Chiang Cheng, Taipei (TW)

(73) Assignee: Getac Technology Corporation, Hsinchu (TW)

( * ) Notice: Subject to any disclaimer, the term of this patent is extended or adjusted under 35 U.S.C. 154(b) by 222 days.

(21) Appl. No.: 12/213,611

(22) Filed: Jun. 23, 2008

(65) Prior Publication Data

US 2009/0115678 A1 May 7, 2009

(30) Foreign Application Priority Data

Nov. 5, 2007 (TW) ..... 96141724 A
Mar. 4, 2008 (TW) ..... 97107522 A

(51) Int. Cl.
*H01Q 9/04* (2006.01)

(52) U.S. Cl. ..... 343/791; 343/790

(58) Field of Classification Search ..... 343/790, 343/791, 792, 900

See application file for complete search history.

(56) References Cited

U.S. PATENT DOCUMENTS 3,508,271 A * 4/1970 Kuecken ..... 343/745
5,995,065 A * 11/1999 Kitchener et al. ..... 343/895
6,266,026 B1 7/2001 Stengel, Jr.
2007/0080878 A1* 4/2007 McLean ..... 343/725

FOREIGN PATENT DOCUMENTS

DE 3732994 4/1989
WO WO96/02075 1/1996
WO WO98/15031 4/1998

OTHER PUBLICATIONS

Communication from the European Patent Office regarding a corresponding foreign application dated Aug. 26, 2008.

Kennedy, et al.; "Investigation of impedance and radiation properties of dual-frequency choke-loaded monopole antennas"; Electronics Letters; Mar. 20, 2003; V. 39, No. 6; (2 pages).

Rogers, et al.; "Wide-band Sleeve-Cage and Sleeve-Helical Antennas"; IEEE Transactions on Antennas and Propagation; vol. 50, No. 10; Oct. 2002; pp. 1409-1414.

* cited by examiner

*Primary Examiner*—HoangAnh T Le

(57) ABSTRACT

Disclosed is a transmission line loaded dual-band monopole antenna, which realizes operation in dual bands with a single antenna. The dual-band monopole antenna includes a monopole antenna and a transmission line load. The monopole antenna has a signal feeding terminal and a load connection terminal. The load connection terminal is connected to the transmission line load. The transmission line load includes a core transmission line, an outer circumferential conductor, and a short-circuit section. The core transmission line has an antenna connection terminal and a short-circuit terminal. The antenna connection terminal is connected to the load connection terminal of the monopole antenna. The outer circumferential conductor circumferentially surrounds and is spaced from the core transmission line and the outer circumferential conductor has an open terminal and a short-circuit terminal. The opening of the open terminal of the outer circumferential conductor faces the antenna connection terminal of the core transmission line so that the outer circumferential conductor forms an open structure facing the monopole antenna.

15 Claims, 17 Drawing Sheets

TRANSMISSION LINE LOADED DUAL-BAND MONOPOLE ANTENNA

FIELD OF THE INVENTION

The present invention relates to the field of monopole antenna, and in particular to a transmission line loaded dual-band monopole antenna.

BACKGROUND OF THE INVENTION

With the popularization of the Internet, network connection becomes an important part of daily life. Wireless network connection that is not subjected to any physical and location constraint is getting prevailing. Further, various portable electronic devices, such as personal digital assistant (PDA), mobile phone, and notebook computer, are made compact and light-weighted generation by generation, providing enhanced portability and as a consequence, wireless techniques are now expanded to wide applications.

Nowadays, various communication protocols set in accordance with the specifications and standards of various wireless digital transmission techniques, such as WLAN (Wireless Local Area Network), Bluetooth, HyperLAN, and IEEE (Institute of Electrical and Electronics Engineers), are employed in wireless communication. And, to provide satisfactory wireless communication on the basis of these protocols, various designs of antenna are available.

The currently available antenna can be classified as dipole antenna, monopole antenna, planar antenna, loop antenna, and disk antenna. Various techniques have been developed for all these kinds of antenna. For patent documents that are currently known, Taiwan Patent Publication No. M241815 discloses a dual-band monopole antenna, wherein the dual-band monopole antenna comprises a substrate, a dual frequency resonance antenna unit, a metal line, and a grounding metal line. The substrate defines a vertical direction and a horizontal direction. The dual frequency resonance antenna unit is comprised of a low-frequency radiation element and a high-frequency radiation element.

The two radiation elements of the dual frequency resonance antenna unit are made up of lines of different lengths and are formed on the substrate in a direction substantially parallel to the vertical direction of the substrate. The dual frequency resonance antenna unit receives vertical polarization components of the high-frequency and low-frequency signals respectively. The line length of the low-frequency radiation element is greater than that of the high-frequency radiation element. Both the low-frequency and the high-frequency radiation elements can be formed as repeatedly curved/bent metal traces.

The metal line is of an L-shape and is formed on the substrate. A long branch of the metal line is substantially parallel to the substrate horizontal direction and connected to terminals of the two radiation elements of the dual frequency resonance antenna unit for connection with a signal feeding line of a coaxial cable. A short branch of the metal line is arranged in a direction parallel to the substrate vertical direction.

The grounding metal line is formed on the substrate and is substantially parallel to the substrate horizontal direction and is connected to the short branch of the metal line for connection with a shielding metal layer of the coaxial cable.

The metal line and the grounding metal line are arranged at unsymmetrical locations to connect to the signal feeding line and the shielding metal layer of the coaxial cable so that the horizontal polarization components do not compensate each other.

SUMMARY OF THE INVENTION

However, for the known monopole antennas of any design, to realize resonance in two bands, a dual-band resonance antenna unit comprised of a low-frequency radiation element and a high-frequency radiation element is needed. In addition, conventionally, to shorten the overall size of a monopole antenna by repeatedly bending the low-frequency and high-frequency radiation elements makes the manufacturing process of the metal traces of the radiation elements complicated and also increases the manufacturing costs.

Thus, an objective of the present invention is to provide a transmission line loaded monopole antenna, wherein resonance in two bands, which is conventionally realized by two monopole antennas, is made possible with a single antenna, while the antenna is maintained in an elongate and slender configuration to facilitate assembling of the antenna.

Another objective of the present invention is to provide a dual-band monopole antenna that is easy to make with a simplified manufacturing process.

The technical solution adopted in the present invention to overcome the above discussed drawbacks includes a transmission line load that is connected in series to a monopole antenna and has a length smaller than a quarter of the wavelength in a designated operation frequency band to serve as an inductive load for reducing a second resonant frequency so as to realize operations in dual bands with a single monopole antenna.

In the relative positions of a transmission line load and a monopole antenna in accordance with the present invention, the monopole antenna comprises an antenna body, a signal feeding terminal, and a load connection terminal. An end of the antenna body forms the signal feeding terminal to which a signal feeding line is connected and an opposite end forms the load connection terminal to which the transmission line load that serves as the load is connected.

In a preferred embodiment of the present invention, the transmission line load comprises a core transmission line, an outer circumferential conductor, a dielectric layer, and a short-circuit section. The core transmission line, which serves as a core conductor, has an antenna connection terminal and a short-circuit terminal. The antenna connection terminal is connected to the load connection terminal of the monopole antenna.

The outer circumferential conductor comprises a circumferentially-extending outer conductor ring that circumferentially surrounds and is spaced from the core transmission line by a given distance, and can be constituted by a screen shield or sheath of a coaxial cable. The outer circumferential conductor has an open terminal and a short-circuit terminal. The open terminal of the outer circumferential conductor is close to the monopole antenna so that the outer circumferential conductor forms an open structure facing the monopole antenna.

The dielectric layer is interposed between the core transmission line and the outer circumferential conductor. The short-circuit section is connected between the short-circuit terminal of the core transmission line and the short-circuit terminal of the outer circumferential conductor.

With the solution provided by the present invention, the monopole that is externally added with a transmission line load features incorporation of an inductive load provided by the transmission line structure of the transmission line load and thus realizes control over high-order resonant frequency. Therefore, the present invention provides a monopole antenna that includes a transmission line load serving as an inductive load, whereby resonance in dual bands that is realized conventionally by two monopole antennas of different line lengths is made possible with a single monopole.

Further, adding a transmission line load, such as a coaxial cable serving as a transmission line structure, to a monopole makes it possible to simplify the manufacturing process by using a currently available coaxial cable. Thus, the transmission line loaded dual-band monopole antenna in accordance with the present invention can be of the advantages of easy manufacturing and maintaining the slender configuration in practical applications. Further, a single bending can be adopted to shorten the appearance length of the monopole antenna of the present invention, enhancing the applicability of the monopole antenna of the present invention in modern compact and light-weighted portable electronic devices.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
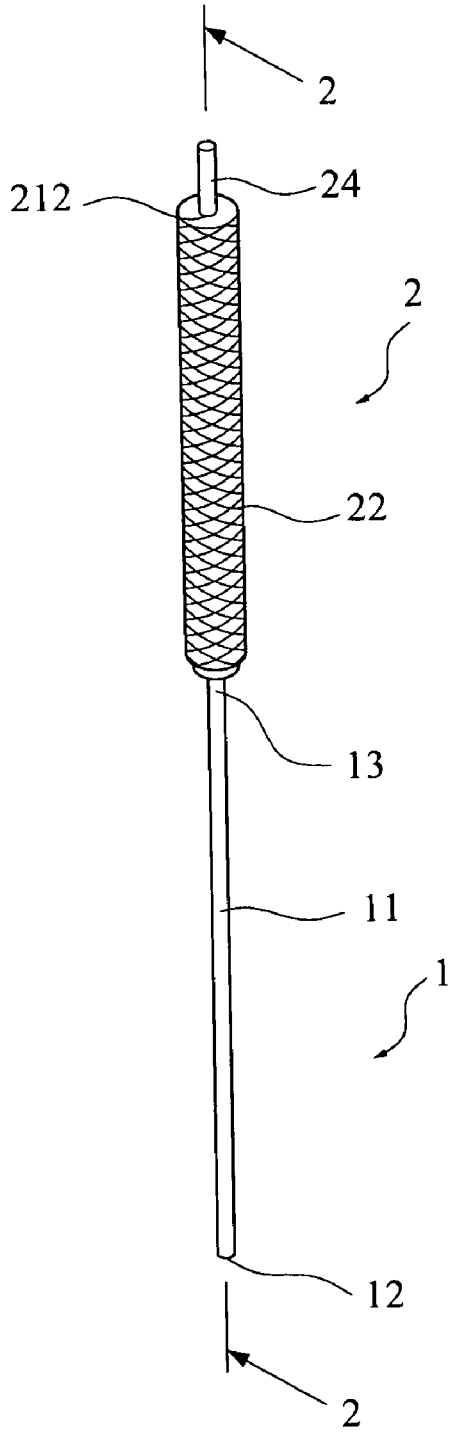
FIG. 1 is a perspective view of a transmission line loaded dual-band monopole antenna constructed in accordance with a first embodiment of the present invention.

With reference to the drawings and in particular to FIG. 1, which shows a perspective view of a transmission line loaded dual-band monopole antenna constructed in accordance with a first embodiment of the present invention, the transmission line loaded dual-band monopole antenna of the present invention is operative in dual bands and is constructed as a monopole antenna added with a transmission line loaded antenna (TLLA) that is loaded with a transmission line. The transmission line that provides the load can be made up of, for example a coaxial cable, parallel conductors, a flexible metal tube or a spiral tube body, and can be positioned at a tail end of the antenna or at a location adjacent to a signal feeding terminal.

Figure 2:
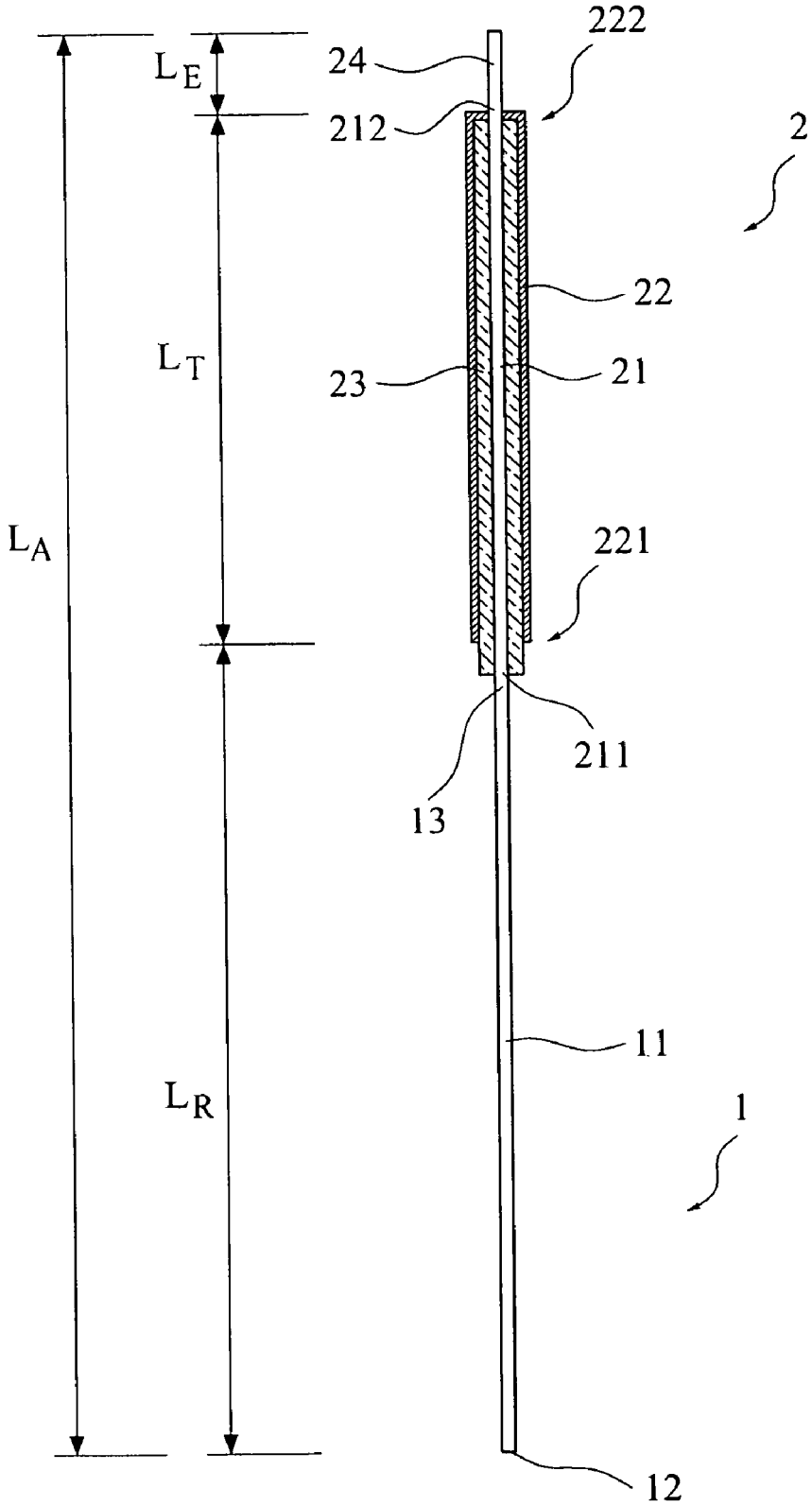
FIG. 2 is a cross-sectional view taken along line 2-2 of FIG. 1.

The spatial relationship between the transmission line load and the antenna itself is arranged as shown in FIG. 1, and can also be referred to in FIG. 2, which is a cross-sectional view taken along line 2-2 of FIG. 1. The monopole antenna 1 comprises an antenna body 11, a signal feeding terminal 12, and a load connection terminal 13.

An end of the antenna body 11 forms the signal feeding terminal 12, and an opposite end forms the load connection terminal 13 and is connected to a transmission line load 2 that serves a load of the antenna. The transmission line load 2 of the present invention is arranged at a distant location with respect to the signal feeding terminal.

As shown in FIG. 2, the transmission line load 2 comprises a core transmission line 21, an outer circumferential conductor 22, a dielectric layer 23, and a short-circuit section 24. The core transmission line 21, which serves as a core conductor, is made of for example copper parts, copper-plated aluminum parts, or copper-plated steel parts and has an antenna connection terminal 211 and a short-circuit terminal 212. The antenna connection terminal 211 is connected to the load connection terminal 13 of the monopole antenna 1.

The outer circumferential conductor 22 comprises a circumferentially-extending outer conductor ring that is arranged to circumferentially surround and spaced from the core transmission line 21 by a given distance, and can be constituted by a screen shield or sheath of a coaxial cable. The outer circumferential conductor 22 has an open terminal 221 and a short-circuit terminal 222. The open terminal 221 of the outer circumferential conductor 22 is close to the monopole antenna 1 so that the outer circumferential conductor 22 forms an open structure facing the monopole antenna 1. The short-circuit terminal 222 is connected to the short-circuit terminal 212 of the core transmission line 21.

The dielectric layer 23 is interposed between the core transmission line 21 and the outer circumferential conductor 22. The dielectric layer 23 can be for example air dielectric or made up of a non-conductive, insulation dielectric material, such as foamed polyethylene. The short-circuit section 24 is extended from the short-circuit terminal 212 of the core transmission line 21 to provide the short-circuit terminal 212 of the core transmission line 21 with a short-circuiting structure.

It is known that adding a capacitive or inductive load allows for control of the high-order second resonant frequency. The present invention is made to resemble the effect by providing a monopole antenna that is loaded by a transmission line structure that serves as a transmission line load 2.

The transmission line load 2 itself can serve as a short-circuited transmission line. When the length of the transmission line load 2 is substantially identical to a quarter of the wavelength of the second resonant frequency, it can serve as an inductive load connected in series to the monopole antenna 1.

For a monopole antenna, the inductive load can affect the high frequency of the second resonance. Thus, the second resonant frequency can be controlled by properly adjusting the length of the transmission line load 2 to eventually provide the monopole antenna 1 with the operability in dual bands.

To demonstrate that the externally added transmission line load 2 can be used to control and adjust the resonant frequency, various parameters are used to observe the frequency response of the antenna. Firstly, the length of the antenna body 11 of the monopole antenna 1 is set as "monopole antenna length $L_R$", the length between the short-circuit terminal 222 of the outer circumferential conductor 22 of the transmission line load 2 and the open terminal 221 of the outer circumferential conductor 22 is "short-circuit transmission line length $L_T$", and the length of the short-circuit section 24 of the transmission line load 2 is "extension section length $L_E$". The overall length $L_A$ of the transmission line loaded dual-band monopole antenna of the present invention is thus the sum of the monopole antenna length $L_R$ plus the short-circuit transmission line length $L_T$ and the extension section length $L_E$.

If the short-circuit transmission line length $L_T$ of the transmission line load 2 is set to be the equivalent quarter of the wavelength of a desired second resonant frequency, and the monopole antenna length $L_R$ is also set to be the equivalent quarter of the wavelength of the desired second resonant frequency, then due to the short-circuit transmission line forming an RF choke at the second resonant frequency, the second resonant frequency is determined by the monopole antenna length $L_R$. Thus, the monopole antenna length $L_R$ can set the second resonance at a given frequency, while the first resonant frequency, which is low frequency, is determined by the overall length $L_A$ and can be adjusted using the extension section length $L_E$.

Figure 3:
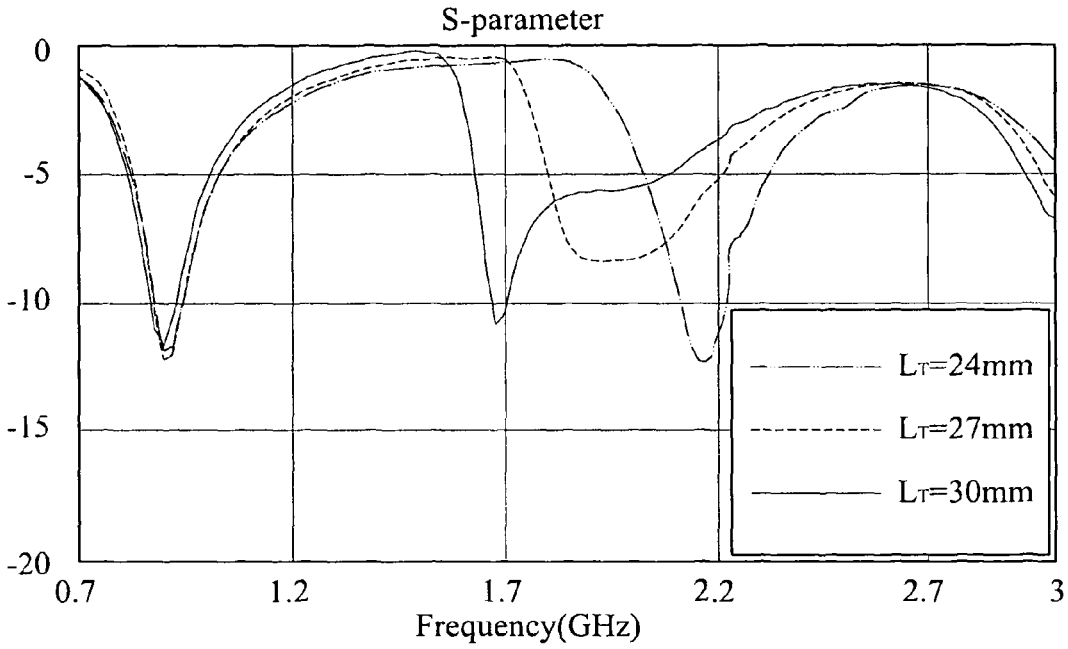
FIG. 3 shows voltage standing wave ratio curves obtained by varying a parameter representing a transmission load length.

FIG. 3 shows voltage standing wave ratio curves obtained by varying a parameter representing the transmission load length. Under the condition that the overall length $L_A$ and the monopole antenna length $L_R$ are both fixed, the influence on the frequency response is observed by varying the parameter of the short-circuit transmission line length $L_T$ to for example 24 mm, 27 mm, and 30 mm.

To keep the overall length $L_A$ and the monopole antenna length $L_R$ fixed, the extension section length $L_E$ varies in accordance with the variation of the short-circuit transmission line length $L_T$. It is observed from the curves that the high-frequency resonant frequency can be controlled by the short-circuit transmission line length $L_T$ solely but the low-frequency resonant frequency is not affected by the variation of the short-circuit transmission line length $L_T$.

Figure 4:
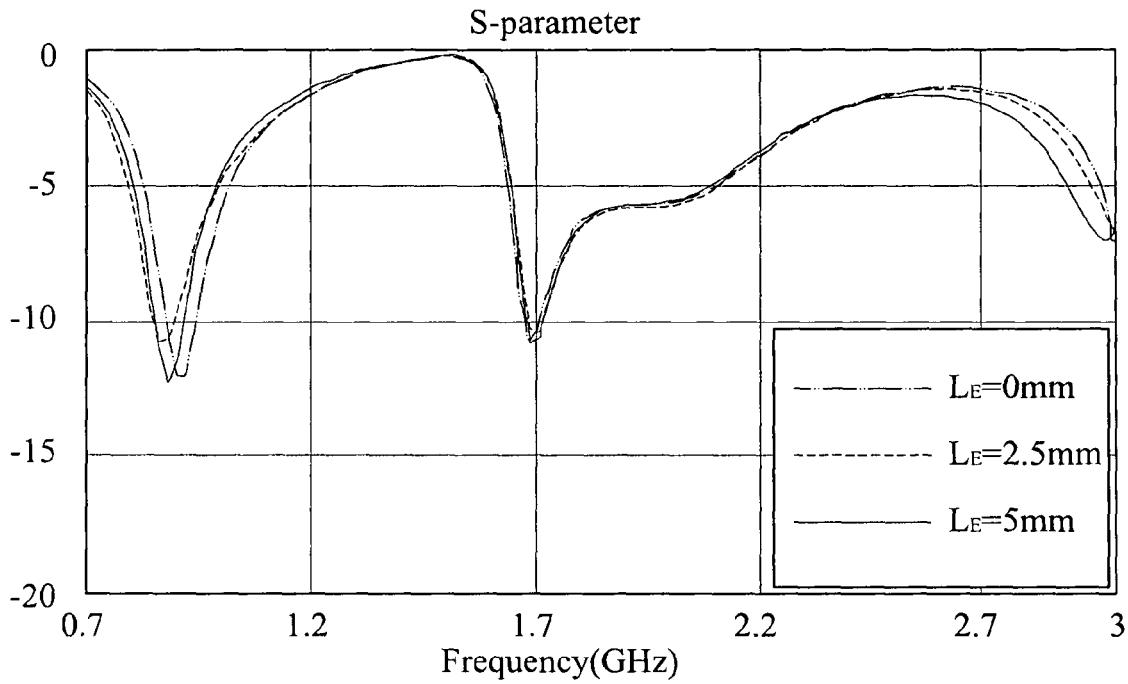
FIG. 4 shows voltage standing wave ratio curves obtained by varying a parameter representing overall length of combination of a transmission line load and a monopole antenna.

FIG. 4 shows voltage standing wave ratio curves obtained by varying the parameter representing the overall length of the combined transmission line load and the monopole antenna. Under the condition that the short-circuit transmission line length $L_T$ and the monopole antenna length $L_R$ are fixed, observation on the influence of the frequency response caused by only varying the overall length $L_A$ is carried out.

With the short-circuit transmission line length $L_T$ and the monopole antenna length $L_R$ being not altered, in order to change the overall length $L_A$, the desired factor for changing the overall length $L_A$ is the extension section length $L_E$, which is respectively set to 0 mm, 2.5 mm, and 5 mm. It is observed from the curves that the low-frequency resonant frequency can be controlled by the extension section length $L_E$ or the overall length $L_A$ solely, but the high-frequency resonant frequency is not affected.

Figure 5:
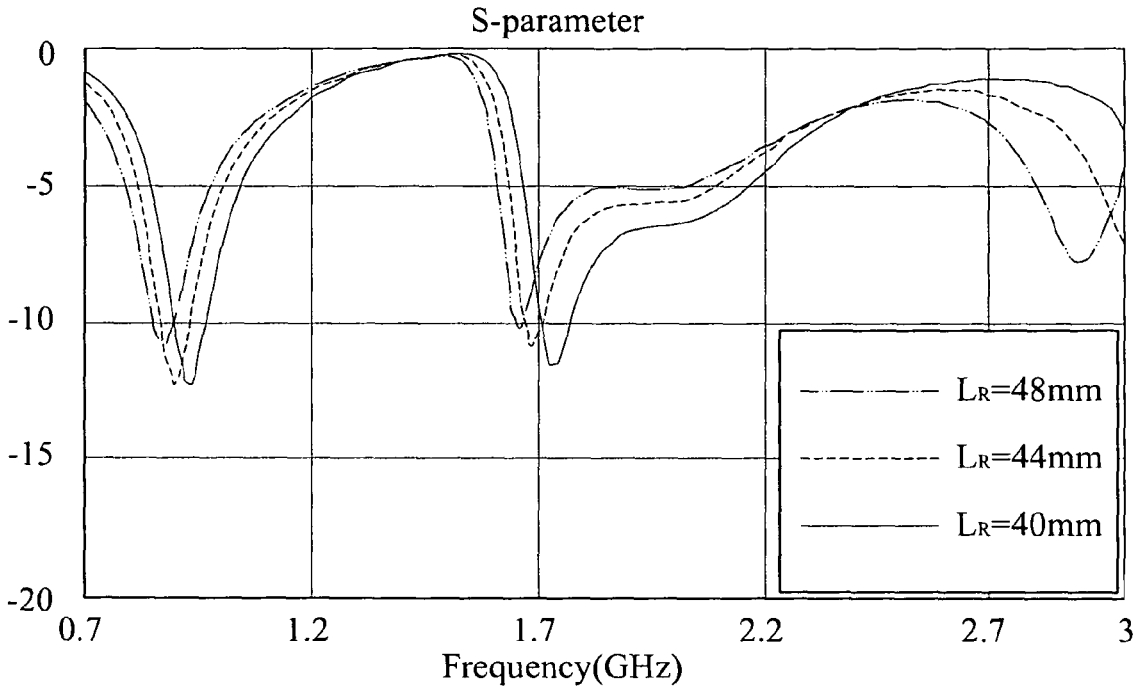
FIG. 5 shows voltage standing wave ratio curves obtained by varying a parameter representing a monopole antenna length.

FIG. 5 shows voltage standing wave ratio curves obtained by varying the parameter representing the monopole antenna length. Under the condition that the short-circuit transmission line length $L_T$ is fixed, observation of the influence of the frequency response by only varying the monopole antenna length $L_R$ is made.

Changing the parameter representing the monopole antenna length $L_R$ to for example 40 mm, 44 mm, and 48 mm causes the overall length $L_A$ to change accordingly. It is observed from the curves that both low-frequency and high-frequency resonant frequencies are shifted together and this can be used to make desired shifting of the overall frequency for the transmission line loaded dual-band monopole antenna in accordance with the present invention.

It reveals from the above discussed experimental data that the transmission line loaded dual-band monopole antenna features high precision control of frequency realized by the independent adjustability of the high frequency and low frequency of the dual bands thereof and the simultaneous shifting of both the high and low frequencies.

Figure 6:
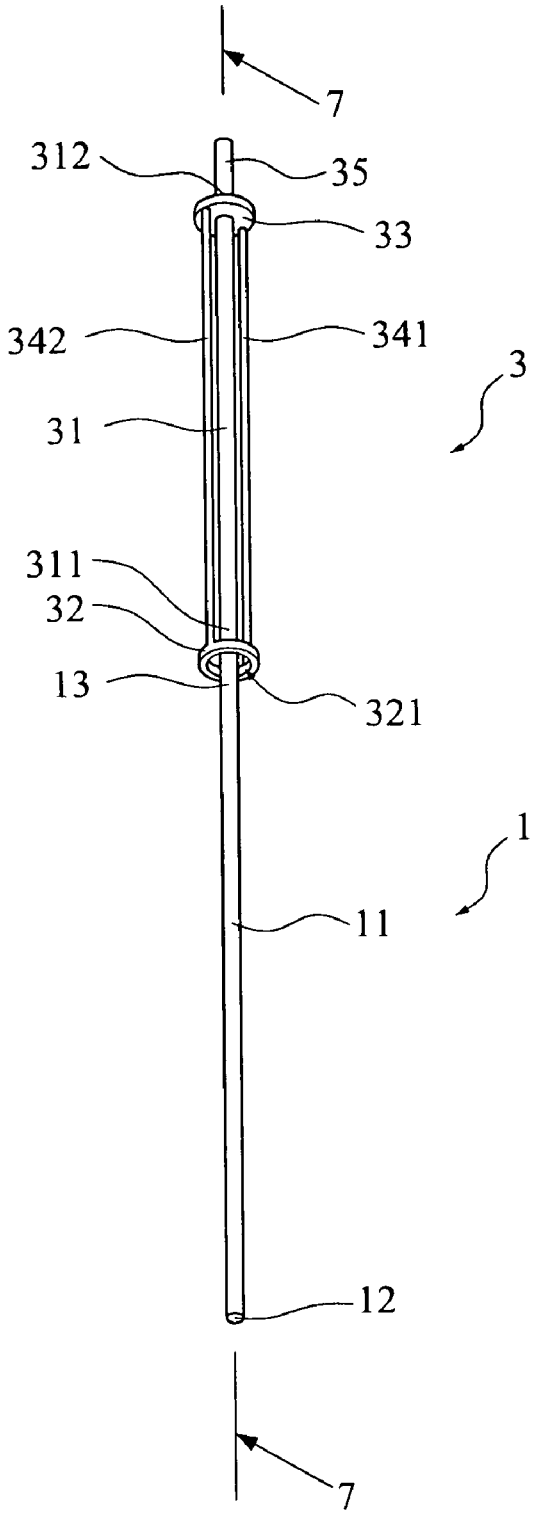
FIG. 6 a perspective view of a transmission line loaded dual-band monopole antenna constructed in accordance with a second embodiment of the present invention.
Figure 7:
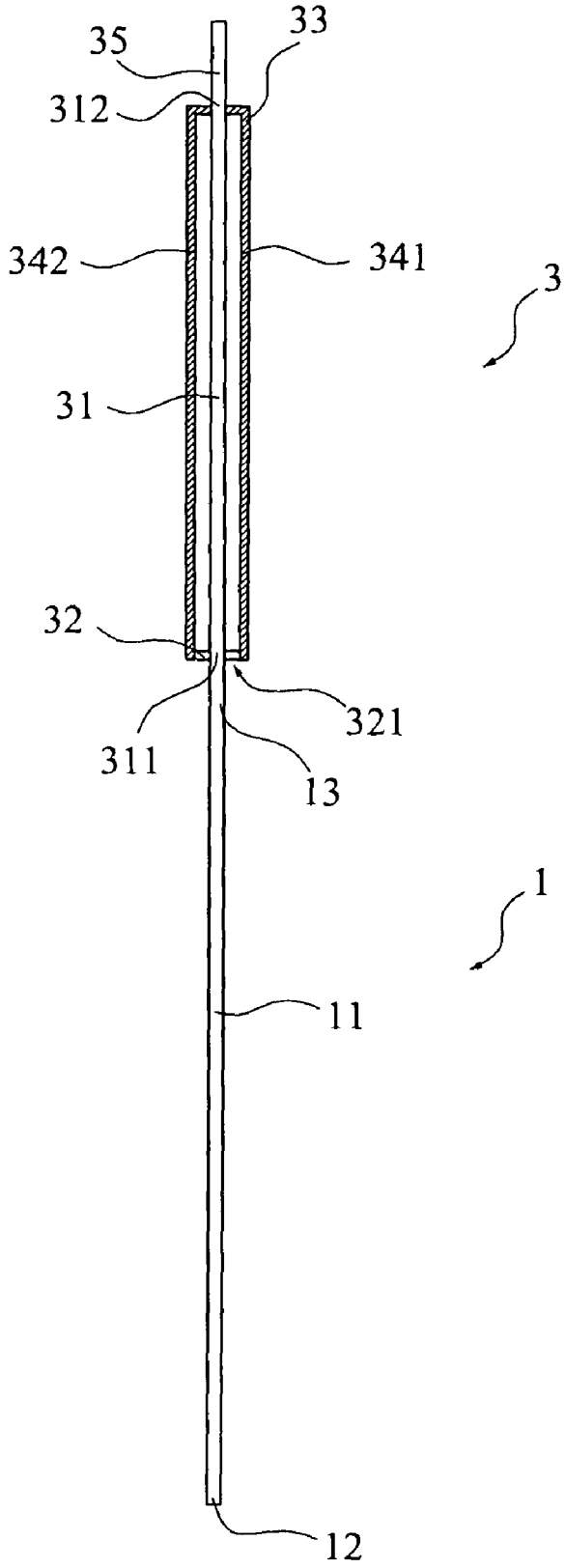
FIG. 7 is a cross-sectional view taken along line 7-7 of FIG. 6.

FIG. 6 shows a perspective view of a transmission line loaded dual-band monopole antenna constructed in accordance with a second embodiment of the present invention, which is also shown in FIG. 7, which is a cross-sectional view taken along line 7-7 of FIG. 6.

An end of an antenna body 11 forms a signal feeding terminal 12, and an opposite end forms a load connection terminal 13 and is connected to a parallel-conductor transmission line that replaces the coaxial cable transmission line of the first embodiment.

The parallel-conductor transmission line load 3 comprises a core transmission line 31, a carrier ring 32, a support ring 33, and a pair of parallel and spaced conductors 341, 342. The core transmission line 31, which serves as a core conductor, has an antenna connection terminal 311 and a short-circuit terminal 312. The antenna connection terminal 311 is connected to a load connection terminal 13 of a monopole antenna 1.

The carrier ring 32 and the support ring 33 are respectively arranged on upper and lower ends of the core transmission line 31 and are spaced from the core transmission line 31 by a given distance. The carrier ring 32 is set at the antenna connection terminal 311 of the core transmission line 31 and forms an open terminal 321. The support ring 33 is set close to the short-circuit terminal 312 of the core transmission line 31. The carrier ring 32 and the support ring 33 are connected to each other by the pair of parallel conductors 341, 342. The two conductors 341, 342 is isolated from and spaced from the core transmission line 31 by a given distance by for example air dielectric or a non-conductive, insulation dielectric material, such as foamed polyethylene. The core transmission line 31 extends beyond the top of the support ring 332 to form a short-circuit section 35.

The outer circumferential conductor 22 of the transmission line load 2 in the first embodiment is now replaced by two opposite conductors 341, 342 of the second embodiment.

Figure 8:
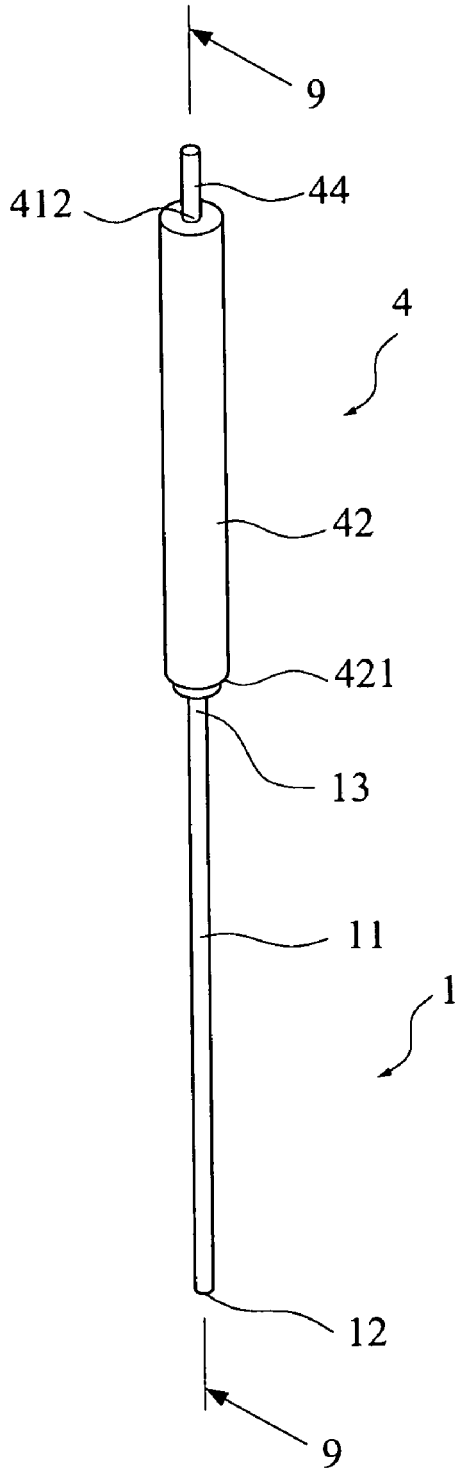
FIG. 8 is a perspective view of a transmission line loaded dual-band monopole antenna constructed in accordance with a third embodiment of the present invention
Figure 9:
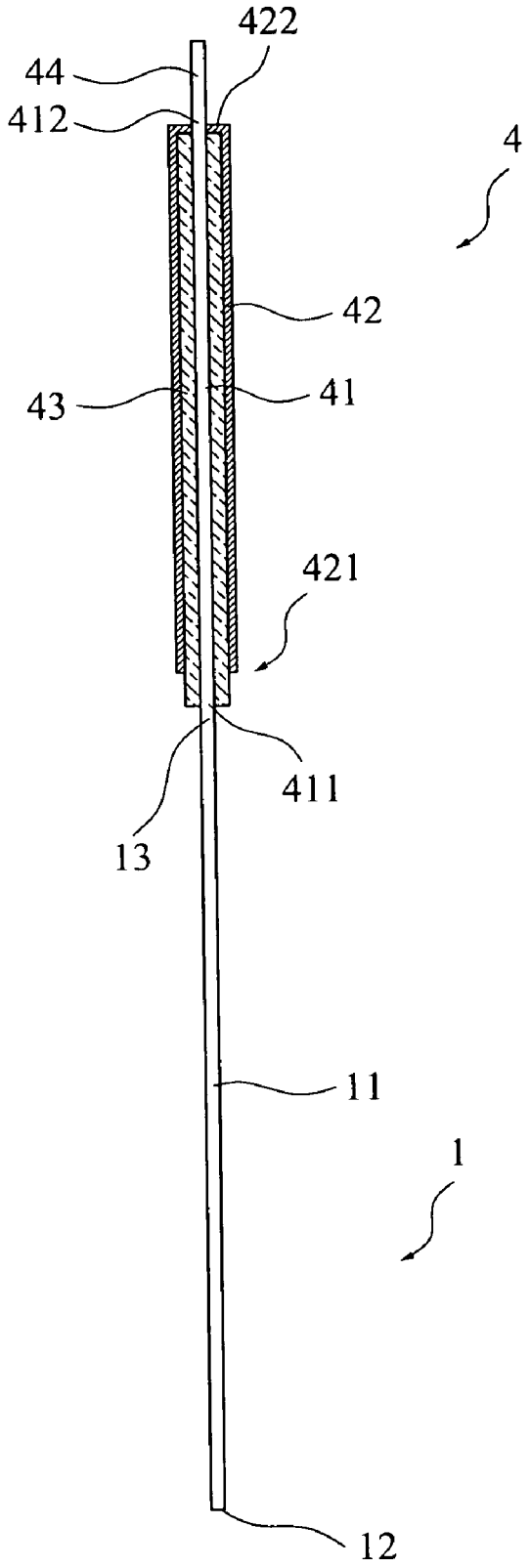
FIG. 9 is a cross-sectional view taken along line 9-9 of FIG. 8.

FIG. 8 shows a perspective view of a transmission line loaded dual-band monopole antenna constructed in accordance with a third embodiment of the present invention, which is also shown in FIG. 9, which is a cross-sectional view taken along line 9-9 of FIG. 8.

A monopole antenna 1 has an antenna body 11 having an end that forms a signal feeding terminal 12, and an opposite end forming a load connection terminal 13 connected to a transmission line load 4.

The transmission line load 4 comprises a core transmission line 41, an outer circumferential conductor 42, a dielectric layer 43, and a short-circuit section 44. The core transmission line 41 has an antenna connection terminal 411 that is connected to the load connection terminal 13 and a short-circuit terminal 412.

The outer circumferential conductor 42 comprises a circumferentially-extending outer conductor ring that circumferentially surrounds and is spaced from the core transmission line 41 by a given distance, and is formed by a flexible metal tube. The outer circumferential conductor 42 has an open terminal 421 and a short-circuit terminal 422. The open terminal 421 of the outer circumferential conductor 42 is close to the monopole antenna 1 so that the outer circumferential conductor 42 forms an open structure facing the monopole antenna 1.

The dielectric layer 43 is interposed between the core transmission line 41 and the outer circumferential conductor 42. The short-circuit section 44 is connected between the short-circuit terminal 412 of the core transmission line 41 and the short-circuit terminal 422 of the outer circumferential conductor 42.

Figure 10:
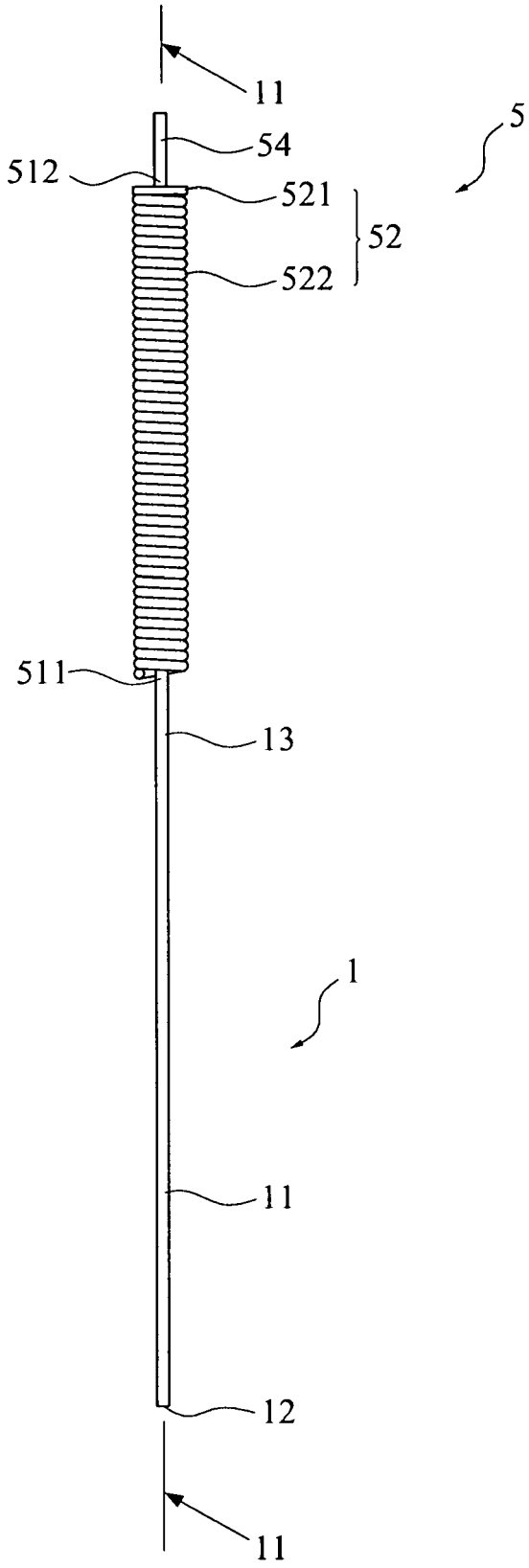
FIG. 10 is a perspective view of a transmission line loaded dual-band monopole antenna constructed in accordance with a fourth embodiment of the present invention.
Figure 11:
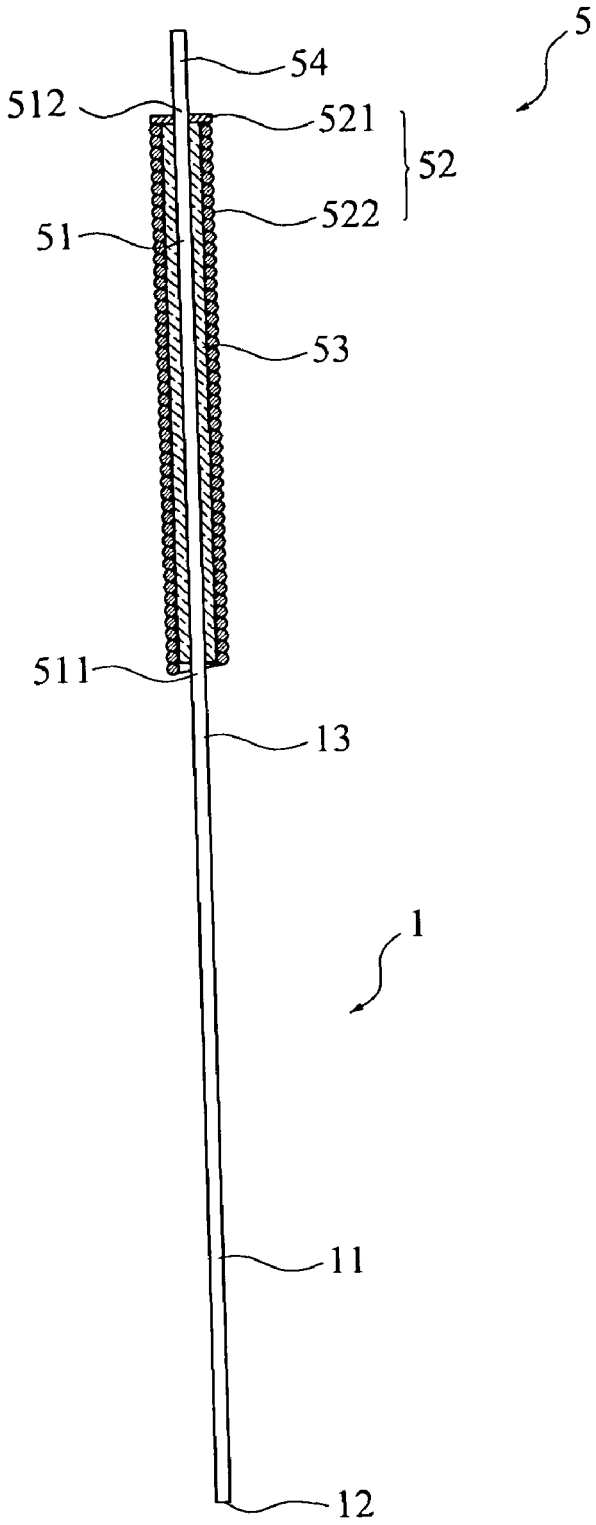
FIG. 11 is a cross-sectional view taken along line 11-11 of FIG. 10.

FIG. 10 shows a perspective view of a transmission line loaded dual-band monopole antenna constructed in accordance with a fourth embodiment of the present invention, which is also shown in FIG. 11, which is a cross-sectional view taken along line 11-11 of FIG. 10.

A monopole antenna 1 comprises antenna body 11 having an end that forms a signal feeding terminal 12, and an opposite end forming a load connection terminal 13 connected to a transmission line load 5.

The transmission line load 5 comprises a core transmission line 51, an outer circumferential conductor 52, a dielectric layer 53, and a short-circuit section 54. The core transmission line 51 has an antenna connection terminal 511 that is connected to the load connection terminal 13 and a short-circuit terminal 512.

The outer circumferential conductor 52 comprises a circumferentially-extending outer conductor ring that circumferentially surrounds and is spaced from the core transmission line 51 by a given distance, and is formed by a support ring 521 and a spiral tube body 522 that is comprised of a plurality of tightly-engaging turns with zero spacing therebetween. The spiral tube body 522 has an end connected to the closed support ring 521 and forms an open structure close to the load connection terminal 13 of the monopole antenna 1.

The dielectric layer 53 is interposed between the core transmission line 51 and the outer circumferential conductor 52. The short-circuit section 54 is connected between the short-circuit terminal 512 of the core transmission line 51 and the support ring 521 of the outer circumferential conductor 52.

Figure 12:
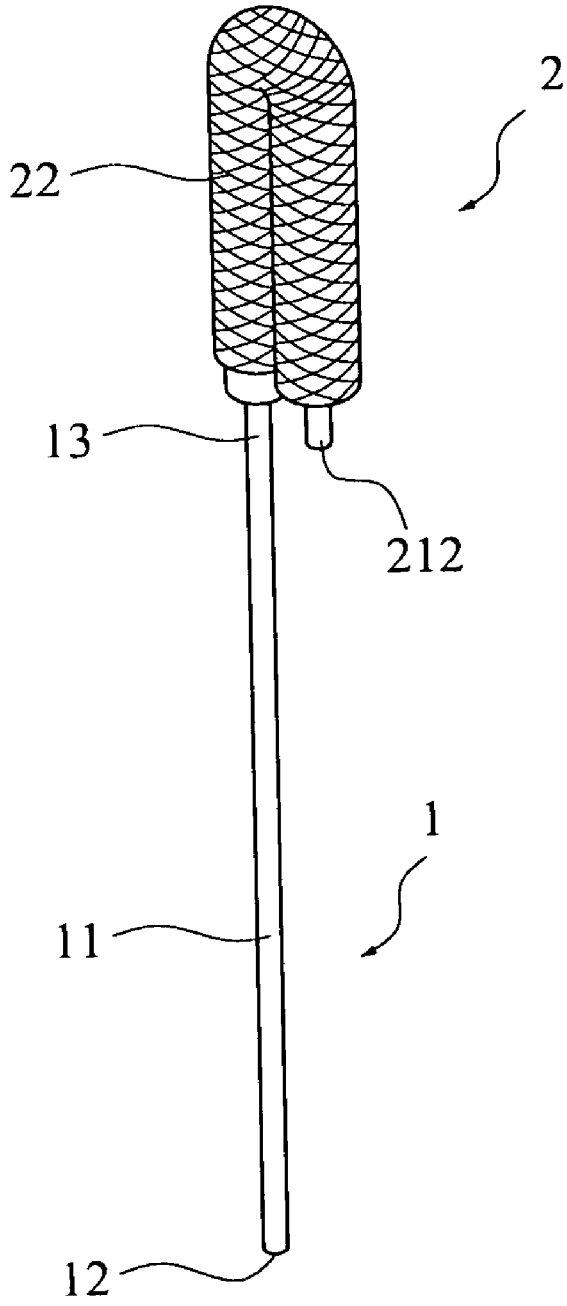
FIG. 12 shows a transmission line loaded dual-band monopole antenna constructed in accordance with a fifth embodiment of the present invention.

FIG. 12 shows a transmission line loaded dual-band monopole antenna constructed in accordance with a fifth embodiment of the present invention, wherein the transmission line load 2 is folded to shorten an appearance length of the transmission line without affecting the length of the transmission path. The transmission line load 2 of FIG. 12 comprises a coaxial cable transmission line, which is bent and folded to shorten the appearance length of the transmission line.

Figure 13:
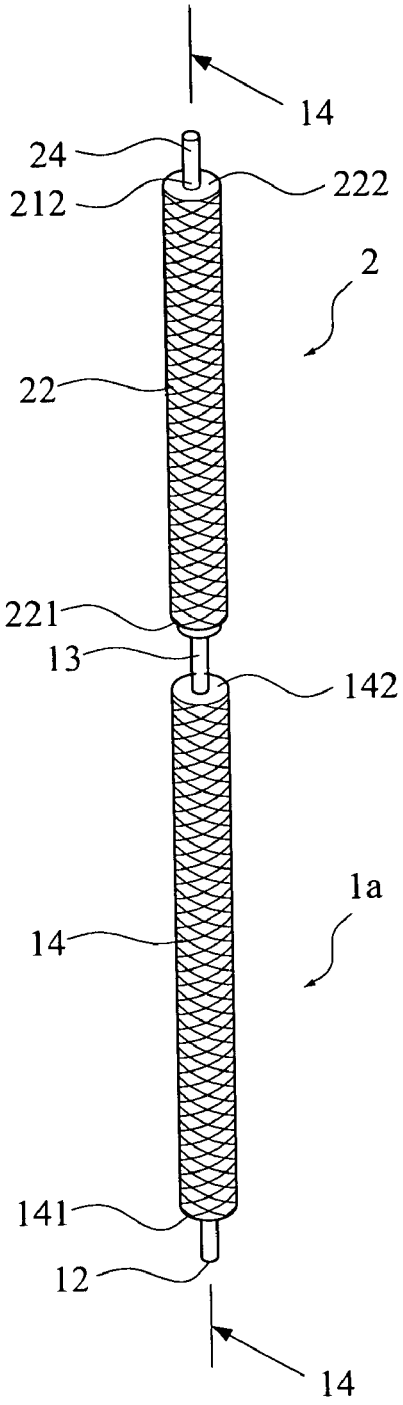
FIG. 13 shows a transmission line loaded dual-band monopole antenna constructed in accordance with a sixth embodiment of the present invention.
Figure 14:
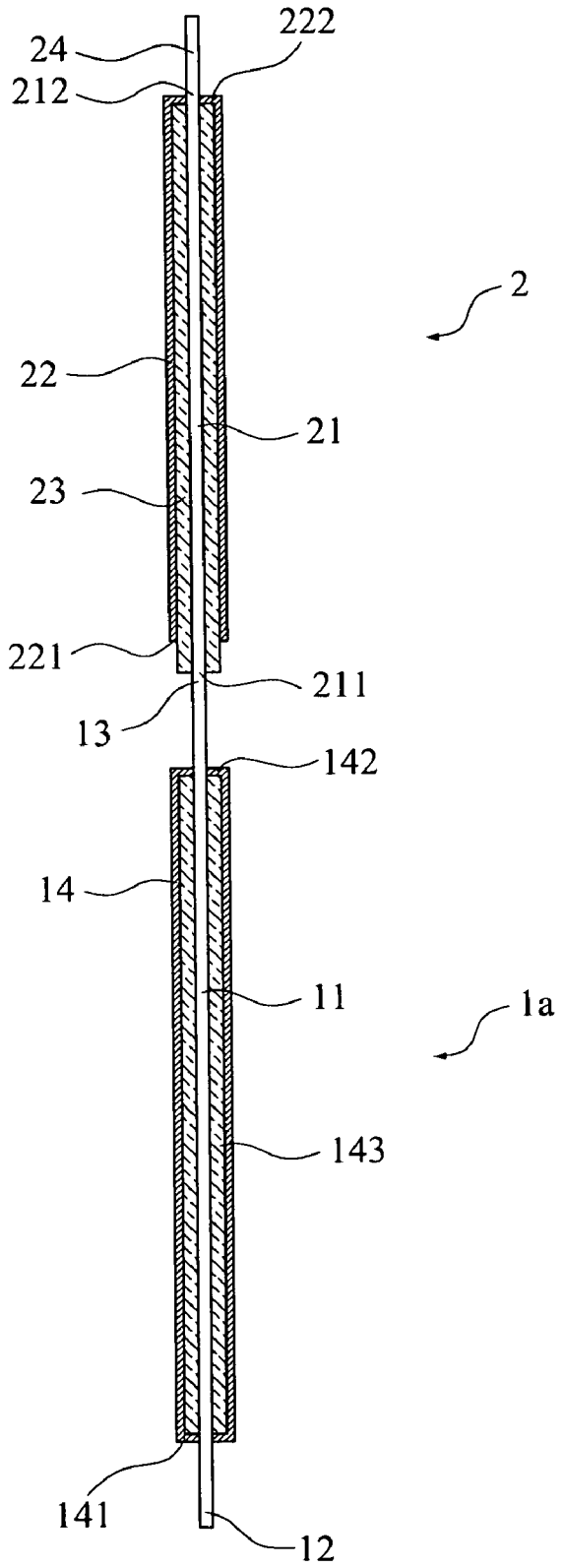
FIG. 14 is a cross-sectional view taken along line 14-14 of FIG. 13.
Figure 15:
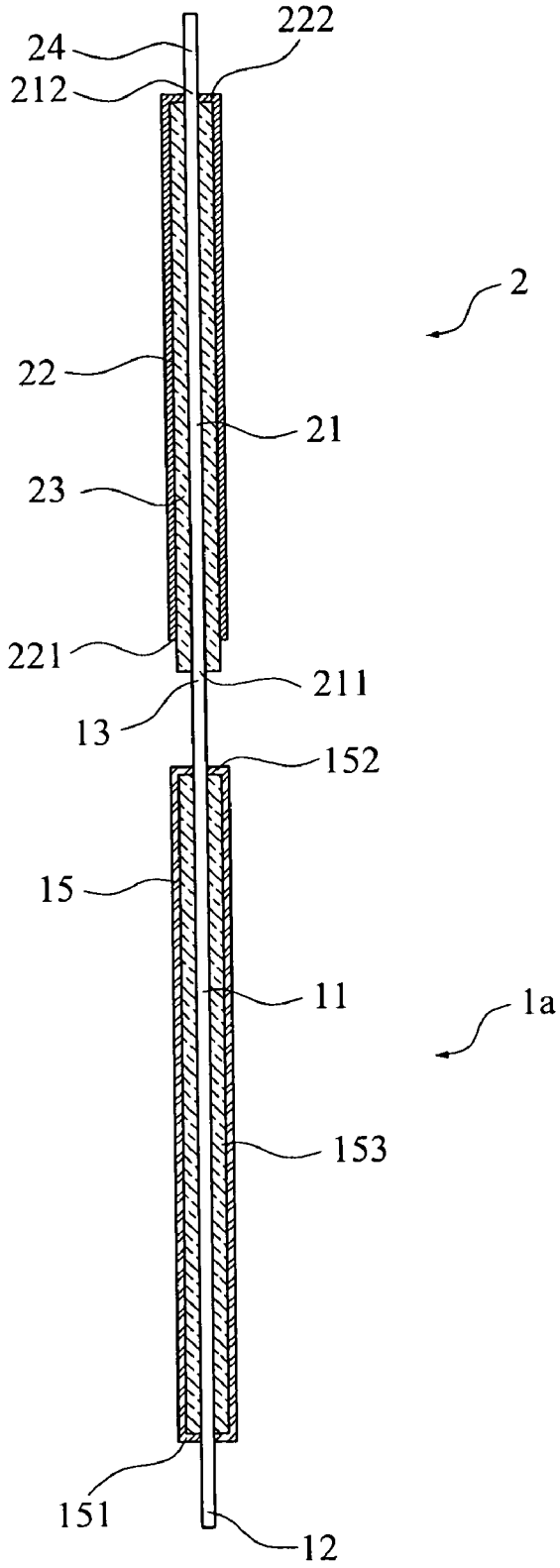
FIG. 15 is a cross-sectional view showing that an outer circumference tubular body is alternatively used as an outer conductor.
Figure 16:
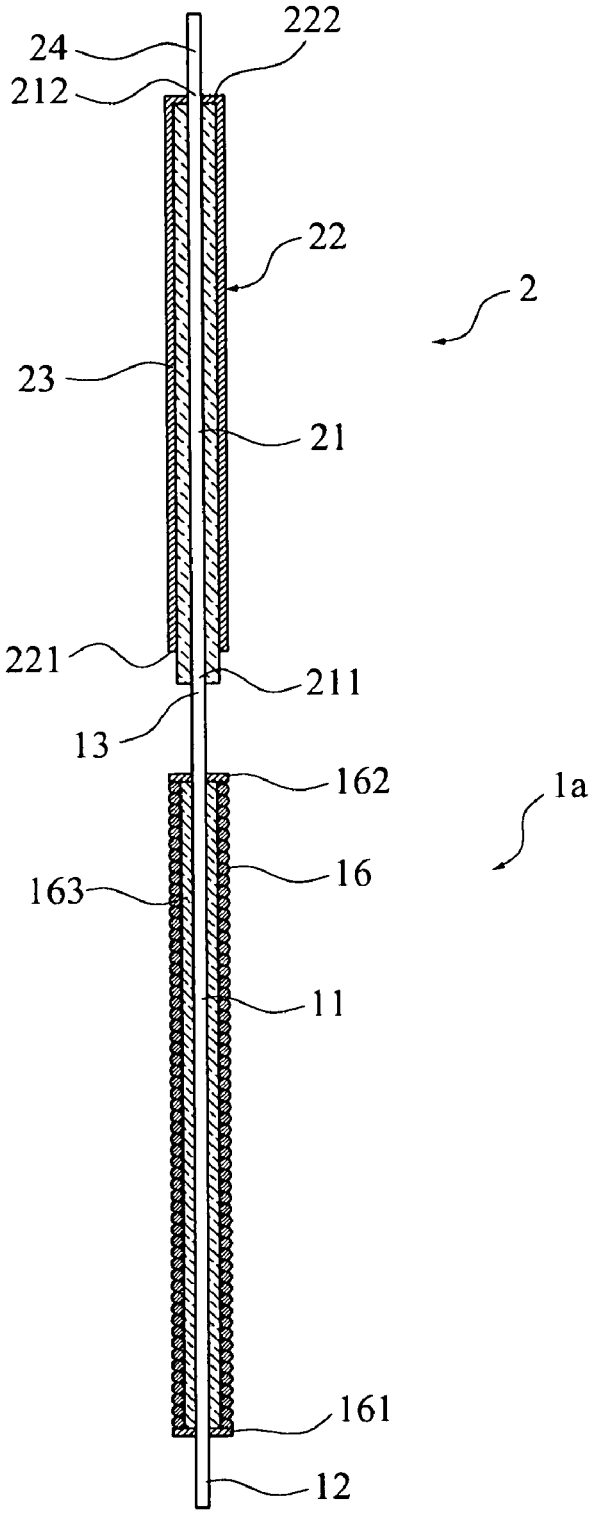
FIG. 16 is a cross-sectional view showing that an outer spiral body is alternatively used as an outer conductor.

FIG. 13 shows a transmission line loaded dual-band monopole antenna constructed in accordance with a sixth embodiment of the present invention and FIGS. 14, 15 and 16 show variation embodiments of an outer conductor of the antenna of FIG. 13.

With simultaneous reference to FIGS. 13 and 14, the transmission line load 2 comprises a core transmission line 21 having an antenna connection terminal 211 that is connected to a load connection terminal 13 of an monopole antenna 1*a* and a short-circuit terminal 212.

The core transmission line 21 is circumferentially surrounded by an outer circumferential conductor 22 that has an open terminal 221 forming an open structure with the opening facing the monopole antenna 1*a* and an opposite terminal that is closed and forms a short-circuit terminal 222.

A dielectric layer 23 is interposed between the core transmission line 21 and the outer circumferential conductor 22. The short-circuit section 24 is connected between the short-circuit terminal 212 of the core transmission line 21 and the short-circuit terminal 222 of the outer circumferential conductor 22.

As shown in FIG. 14, the monopole antenna 1*a* is further surrounded by an outer conductor 14 in the form of a coaxial cable in the portion adjacent to a signal feeding terminal 12. Both ends of the outer conductor 14 form closed terminals 141, 142, this being different from the outer circumferential conductor 22 that has an open structure formed by an open terminal 221. A dielectric layer 143 is interposed between an antenna body 11 of the monopole antenna 1*a* and the outer conductor 14.

The outer conductor 14 added to the monopole antenna 1*a* provides the antenna body 11 with a section having a relatively large diameter to realize a great bandwidth.

As shown in FIG. 15, the monopole antenna 1*a* is alternatively surrounded by an outer circumference tubular body 15 having opposite ends that are closed terminals 151, 152. A dielectric layer 153 is interposed between the antenna body 11 of the monopole antenna 1*a* and the outer circumference tubular body 15.

The outer circumference tubular body 15 added to the monopole antenna 1*a* provides a section of relatively large diameter to realize a great bandwidth.

As shown in FIG. 16, the monopole antenna 1*a* is alternatively surrounded by an outer spiral body 16 having opposite ends that are closed and form support rings 161, 162. A dielectric layer 163 is interposed between an antenna body 11 of the monopole antenna 1*a* and the outer spiral body 16.

The outer spiral body 16 added to the monopole antenna 1*a* provides the antenna body 11 with a section having a relatively large diameter to realize a great bandwidth.

Figure 17:
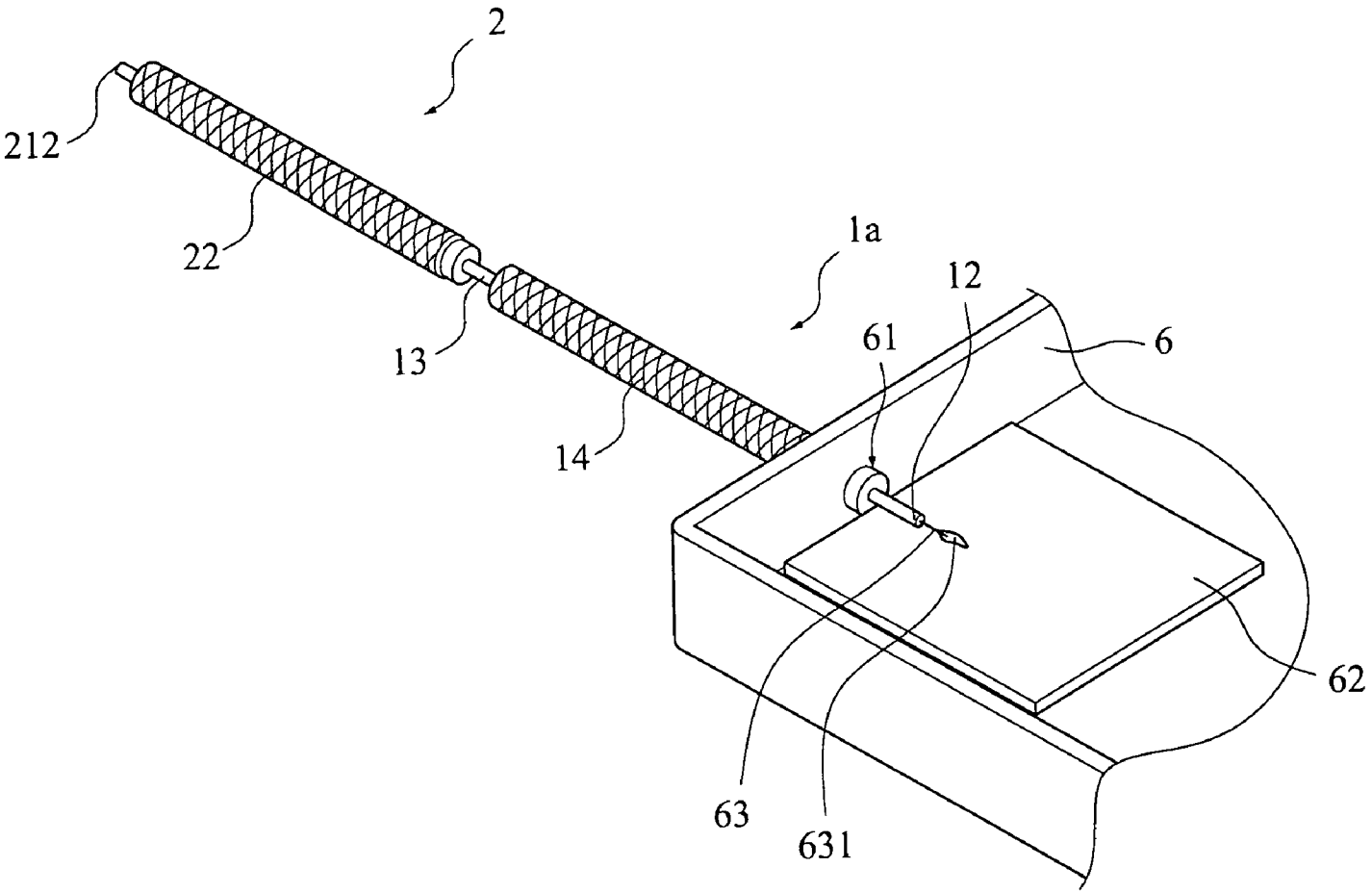
FIG. 17 is a perspective view of a transmission line loaded dual-band monopole antenna constructed in accordance with a seventh embodiment of the present invention.

FIG. 17 shows a perspective view of a transmission line loaded dual-band monopole antenna constructed in accordance with a seventh embodiment of the present invention. An enclosure 6 of an electronic device has a surface forming in a suitable location an antenna mounting hole 61. The signal feeding terminal 12 of the monopole antenna 1*a* is mounted to the surface of the enclosure 6 through the antenna mounting hole 61 defined in the surface of the enclosure 6.

The signal feeding terminal 12 of the monopole antenna 1*a* that extends through the antenna mounting hole 61 defined in the surface of the enclosure 6 is set in connection with a circuit board 62 that mates the monopole antenna 1*a*. The circuit board 62 is arranged at an end of the enclosure 6. A hot wire 631 of an end of a feeding signal transmission path 63 is connected to the signal feeding terminal 12 of the monopole antenna 1*a* and an opposite end serves as a grounding wire connected to the enclosure to thereby make the enclosure 6 a portion of the monopole antenna 1*a*.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A dual-band monopole antenna comprising:

a monopole antenna having a signal feeding terminal and a load connection terminal; and a transmission line load comprising:

a core transmission line having an antenna connection terminal and a short-circuit terminal, the antenna connection terminal being in connection with the load connection terminal of the monopole antenna;

an outer circumferential conductor circumferentially surrounding and spaced from the core transmission line, the outer circumferential conductor having an open terminal and a short-circuit terminal opposite to the open terminal, the short-circuit terminal being connected to the short-circuit terminal of the core transmission line, so that the outer circumferential conductor forms an open structure facing the monopole antenna; and a short-circuit section extended from the short-circuit terminal of the core transmission line to provide the short-circuit terminal of the core transmission line with a short-circuiting structure;

wherein a length from the short-circuit terminal of the core transmission line to the open terminal of the outer circumferential conductor forms a short-circuit transmission line length, the short-circuit transmission line length corresponding to an equivalent quarter of a wavelength of a predetermined second resonant frequency, a combined overall length of the monopole antenna and the transmission line load being set corresponding to an equivalent quarter of a wavelength of a predetermined first resonant frequency, such that the first resonant frequency is determined by a length of the short-circuit section that is connected to the short-circuit terminal of the core transmission line.

2. The dual-band monopole antenna as claimed in claim 1 further comprising a dielectric layer interposed between the core transmission line and the outer circumferential conductor.

3. The dual-band monopole antenna as claimed in claim 2, wherein the dielectric layer comprises dielectric selected from a group consisting of air and an insulation material of foamed polyethylene.

4. The dual-band monopole antenna as claimed in claim 1, wherein the transmission line load comprises a transmission line formed by a length of coaxial cable and wherein the outer circumferential conductor is formed by a screen shield of the coaxial cable.

5. The dual-band monopole antenna as claimed in claim 1, wherein the outer circumferential conductor comprises at least two parallel and spaced conductors.

6. The dual-band monopole antenna as claimed in claim 1, wherein the outer circumferential conductor comprises an outer spiral tube body.

7. The dual-band monopole antenna as claimed in claim 1, wherein the outer circumferential conductor comprises a flexible metal tube.

8. The dual-band monopole antenna as claimed in claim 1, wherein the transmission line load comprises an inductive load connected in series with the monopole antenna.

9. The dual-band monopole antenna as claimed in claim 1 further comprising an outer conductor having a relatively large diameter arranged on a section close to the signal feeding terminal of the monopole antenna.

10. The dual-band monopole antenna as claimed in claim 1 further comprising an outer circumference tubular body having a relatively large diameter arranged on a section close to the signal feeding terminal of the monopole antenna.

11. The dual-band monopole antenna as claimed in claim 1 further comprising an outer spiral body having a relatively large diameter arranged on a section close to the signal feeding terminal of the monopole antenna.

12. The dual-band monopole antenna as claimed in claim 1, wherein the signal feeding terminal of the monopole antenna is connected to a mating circuit board via a feeding signal transmission path, and is mounted at an enclosure.

13. The dual-band monopole antenna as claimed in claim 12, wherein the feeding signal transmission path has an end forming a signal end connected to the monopole antenna and the enclosure serving as a grounding point for the antenna.

14. The dual-band monopole antenna as claimed in claim 1, wherein the transmission line load is folded sideways to shorten length of the transmission line load.

15. The dual-band monopole antenna as claimed in claim 1, wherein the monopole antenna length corresponds to an equivalent quarter of a wavelength of a predetermined second resonant frequency.

* * * * *